US008127756B2

(12) United States Patent
Kitahara

(10) Patent No.: US 8,127,756 B2
(45) Date of Patent: Mar. 6, 2012

(54) METHOD OF GRINDING CONCRETE BLOCK AND APPARATUS FOR GRINDING CONCRETE BLOCK

(75) Inventor: Tetsugoro Kitahara, Okayama (JP)

(73) Assignee: Tiger Machine Co., Ltd., Okayama (JP)

( * ) Notice: Subject to any disclaimer, the term of this patent is extended or adjusted under 35 U.S.C. 154(b) by 1023 days.

(21) Appl. No.: 12/077,247

(22) Filed: Mar. 18, 2008

(65) Prior Publication Data

US 2009/0151295 A1 Jun. 18, 2009

(30) Foreign Application Priority Data

Dec. 12, 2007 (JP) ..... 2007-320433

(51) Int. Cl.
*B28D 7/04* (2006.01)
*B28D 1/32* (2006.01)

(52) U.S. Cl. ..... 125/35; 125/9; 125/25; 451/352

(58) Field of Classification Search ..... 125/12, 125/14, 16, 13.01, 1–3, 35; 451/352; 425/385
See application file for complete search history.

(56) References Cited

U.S. PATENT DOCUMENTS 3,550,575 A * 12/1970 Metzger et al. ..... 125/3
6,109,906 A * 8/2000 Castonguay et al. ..... 425/343
6,540,501 B1 * 4/2003 Bott ..... 425/385
(Continued)

FOREIGN PATENT DOCUMENTS

CA 2 463 406 10/2004
(Continued)

*Primary Examiner* — Dung Van Nguyen
(74) *Attorney, Agent, or Firm* — Flynn, Thiel, Boutell & Tanis, P.C.

(57) ABSTRACT

The present method of grinding side ridge line portion and a side surface of concrete blocks having the flowing steps: providing a rotating shaft of the grinding machine to be rotationally supported by lower ends of two vertical bars facing each other in the direction in which a conveyor is advanced and suspended from a frame above the conveyor and positioning an axis of the rotating shaft to be laterally and above the conveyor, moving the concrete blocks to a position where it is ground by the conveyor and then positioning the concrete blocks to make side ridge line portions on the bottom surfaces thereof protrude from the conveyor, and grinding the side ridge line portions and/or side surfaces on the upper or the bottom surface of the concrete block by lowering the grinding machine suspended from above the concrete block, the side ridge line portions and/or the side surfaces of the concrete blocks are ground by abutting the grinding machine against the surface of concrete blocks, while at the same time rotating the rotating shaft by a rotating means.

4 Claims, 5 Drawing Sheets

U.S. PATENT DOCUMENTS

| | | | | |
|---|---|---|---|---|
| 6,877,502 | B2 * | 4/2005 | Register | 125/13.01 |
| 6,941,939 | B2 * | 9/2005 | Pedrini | 125/3 |
| 6,994,081 | B2 * | 2/2006 | Pedersen et al. | 125/35 |
| 2005/0172947 | A1 | 8/2005 | Pedersen et al. | |
| 2008/0276922 | A1 * | 11/2008 | Price | 125/26 |

FOREIGN PATENT DOCUMENTS

| | | |
|---|---|---|
| JP | 1-156010 | 6/1989 |
| JP | 2000-301523 | 10/2000 |
| JP | 2001-269920 | 10/2001 |
| JP | 2005-007625 | 1/2005 |

* cited by examiner

METHOD OF GRINDING CONCRETE BLOCK AND APPARATUS FOR GRINDING CONCRETE BLOCK

BACKGROUND OF THE INVENTION

1. Field of the Invention

The present invention relates to a method of grinding concrete block and an apparatus for grinding concrete block, and more particularly, to a method of grinding concrete block and an apparatus for grinding concrete block which are capable of increasing a production efficiency without depositing ground block pieces on a conveyor.

2. Description of the Related Art

Conventionally, a trammel rotor has been mainly adopted as a means for machining a ridge line of concrete blocks. This trammel rotor includes a cylindrical hollow rotating body with a length of 3 to 6 meters diagonally positioned. The ridge lines can be roughly ground by rotating the rotating body. More specifically, concrete blocks can be mixed within the rotating body so that the concrete blocks are caused to contact with each other. According to this method, since it takes a lot of time to machine concrete blocks and machined concrete blocks are not aligned with each other, it was necessary for the ground concrete blocks to be arranged when they are shipped.

Therefore, a method of machining the surface of concrete blocks being transported by a conveyor by a grinding machine was developed. For example, a shot blast machining method (e.g., see Japanese Patent Laid-open Publication HEI01-156010) and a method of jetting a high pressurized water flow or an air flow toward the surface to be machined (e.g., see Japanese Patent Laid-open Publication 2001-269920 and Japanese Patent Laid-open Publication 2000-301523) were devised. However, according to these methods, it was difficult to roughly grind only ridge lines of the concrete block in a natural manner and the facilities were bulky.

In view of the above technical problems, the present inventor developed a technology wherein the ridge lines of the concrete block could be ground by lowering a blade for grinding the concrete blocks, while at the same time vibrating said blade by a vibrator (Japanese Patent Laid-open Publication 2005-7625).

According to said technology, the ridge lines of the concrete block could be roughly ground in a natural manner.

However, it was necessary to design the blades in accordance with the size of the concrete block.

In addition, the ground concrete pieces were deposited on the conveyor, due to the fact that the blade had to be abutted against the ridge lines of the concrete block while at the same time it was vibrated.

Further, it was difficult to grind the side ridge lines on the bottom surface of the concrete block.

DISCLOSURE OF THE PRESENT INVENTION

Problems to be Solved by the Present Invention

In view of the above, the object of the present invention is to provide a method of grinding concrete blocks and an apparatus for grinding concrete blocks which are capable of stably grinding side ridge lines and the side surface of the concrete blocks to provide natural and rough ground surfaces, irrespective of the size of the concrete blocks.

Another object of the present invention is to provide a method of grinding concrete blocks and an apparatus for grinding concrete blocks which are capable of improving an efficiency for grinding the concrete blocks.

Still another object of the present invention is to provide a method of grinding concrete blocks and an apparatus for grinding concrete blocks which are capable of grinding the concrete block so as not to deposit the ground concrete pieces on the conveyor.

Still another object of the present invention is to provide a method of grinding concrete blocks and an apparatus for grinding concrete blocks which are capable of grinding the side ridge lines on the bottom surface of the concrete block as the occasion demands.

According to the present invention, there is provided a method of grinding concrete blocks comprising the following steps: providing a rotating shaft of the grinding machine so as to be rotationally supported by lower ends of two vertical bars facing each other in the direction in which a conveyor is advanced and suspended from a frame above said conveyor and positioning an axis of said rotating shaft to be laterally and above the conveyor, moving the concrete blocks to a position where it is ground by the conveyor and then positioning the concrete blocks so as to make side ridge line portions on the bottom surfaces thereof protrude from the conveyor, and grinding the side ridge line portions and/or side surfaces on the upper or the bottom surface of the concrete block by lowering the grinding machine suspended from above the concrete block, whereby the side ridge line portions and/or the side surfaces of the concrete blocks are ground by abutting the grinding machine against the surface of concrete blocks, while at the same time rotating the rotating shaft by a rotating means.

It is preferred that a means for pressing the upper surface other than the ridge line of the concrete block from above is provided in a case where the ridge line of the concrete block remained stationary is to be ground.

It is preferred that in a case where the side ridge line portion on the upper surface of the concrete block is to be ground, the grinding machine is rotated from above to below at a grinding position, while in a case where the side ridge line portion on the bottom surface of the concrete block is to be ground, the grinding machine is rotated from below to above at a grinding position by switching the rotating direction.

It is preferred that a plurality of chains are provided on the peripheral surface of the rotating shaft.

According to the present invention, there is provided an apparatus for grinding concrete blocks comprising: a conveyor which transports the concrete blocks to a position where they are ground; a frame disposed to be above the conveyor; a grinding machine which is suspended from a frame disposed to be above the conveyor and rotationally supported at lower ends of two vertical bars suspended from said frame and facing each other in the direction in which the conveyor is advanced; a rotating shaft of said grinding machine which is rotationally supported by said two vertical bars; and means for rotating said rotating shaft, whereby ridge line portions and/or side surfaces of the concrete blocks on the upper and the bottom surfaces of the concrete block can be ground by positioning the side ridge line portions on a bottom surface of the concrete block so as to protrude from the conveyor and positioning the axis of the rotating shaft to be laterally and above the conveyor and then lowering the grinding machine so as to abut its surface against the said ridge line portions and/or side surfaces.

It is preferred that the apparatus for grinding concrete blocks further includes means for pressing from above an upper surface of the concrete block remained stationary other than the ridge lines thereof.

It is preferred that the apparatus for grinding concrete blocks further includes means for switching the direction in which the grinding machine is rotated, whereby in a case where the side ridge portion on the upper surface of the concrete block is ground, the grinding machine is rotated from above to below at the grinding position, while in a case where the side ridge portion on the bottom surface of the concrete block is ground, the grinding machine is rotated from below to above at the grinding position.

It is preferred that said grinding fittings are formed by chains.

Effect of the Present Invention

According to the present invention, the side ridge line of the concrete block can be ground in a stable manner so as to obtain a natural rough ground surface, irrespective of the size of the concrete block. In addition, the efficiency for grinding the concrete block can be improved. Further, the ground block pieces are prevented from being deposited on the conveyor, and a space is secured around the conveyor. Still further, the side ridge line portions on the bottom surface of the concrete block can be ground as the occasion demands.

PREFERRED EMBODIMENTS

Figure 1:
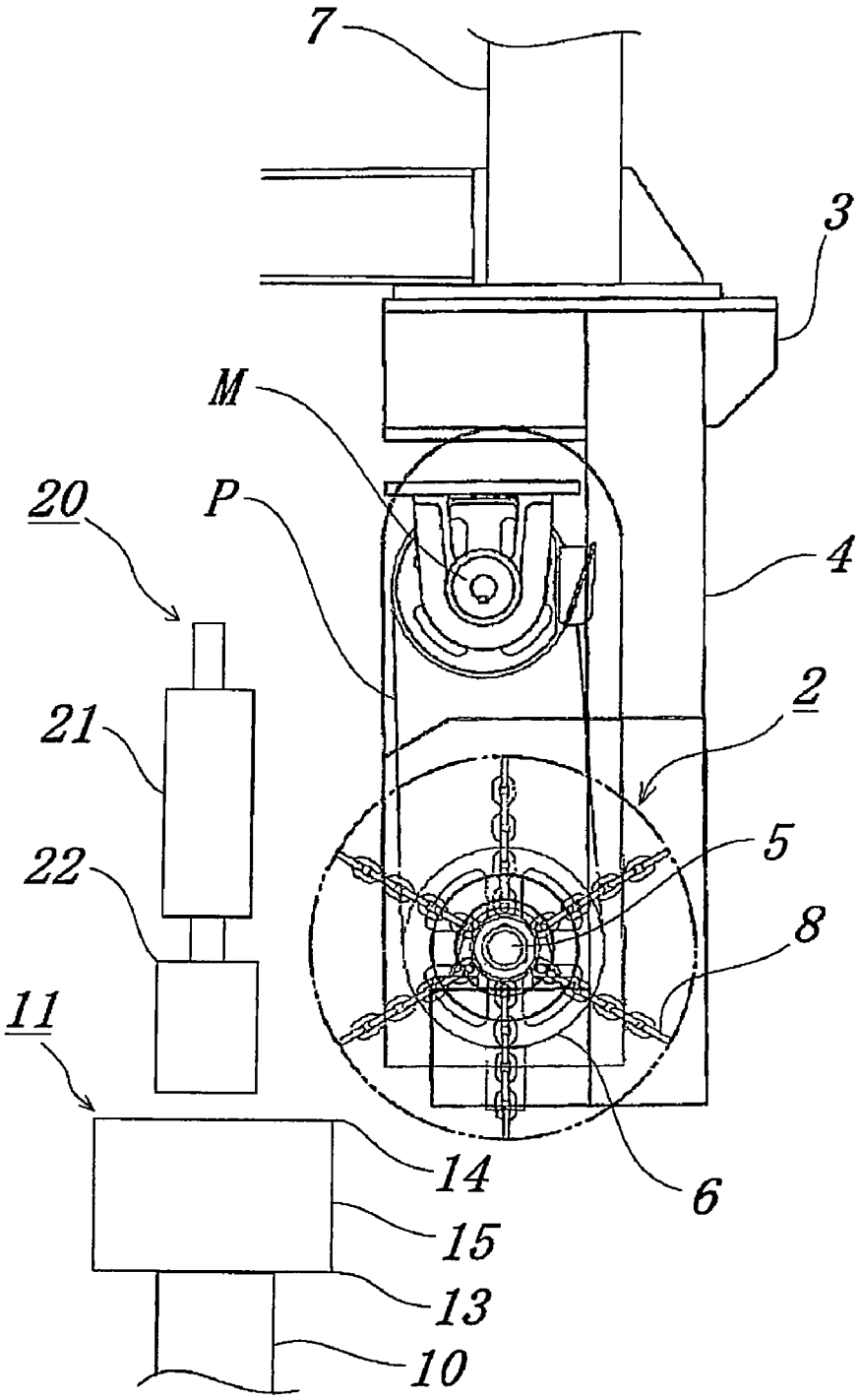
FIG. 1 is a view showing a first embodiment of a structure of a grinding apparatus of the present invention seen along the direction in which a conveyor is advanced.

The concrete embodiments of the present invention will be described in detail. Each of the following embodiments are only an example of the apparatus for grinding concrete blocks and does not limit the present invention.

The concrete blocks broken by a splitter machine are disposed on a conveyor to be transported to the grinding machine of the present embodiment.

The concrete block transported is stationary placed on a position where it is to be ground by the grinding machine. It is necessary that the side ridge lines on the bottom surface of the concrete block protrude from the conveyor.

At this stage, the grinding machine for grinding the ridge line of the concrete block is suspended from a frame disposed to be above the conveyor. The grinding machine is rotationally supported at the lower ends of the two vertical bars facing each other along the direction in which the conveyor is advanced. A frame is provided so as to bride the upper ends of the vertical bars, so that it is possible for the grinding machine to be moved upwardly and downwardly due to the fact that a cylinder is disposed to be above the center of the frame.

As described above, since the grinding machine is suspended from above the conveyor, it is possible to secure a space without arranging machinery for driving the grinding machine around the conveyor. This causes the efficiency of cleaning ground pieces deposited around the conveyor to be improved.

As described above, the grinding machine is rotationally supported at the lower ends of the vertical bars, and furthermore, a bearing is provided at the end of a shaft of the grinding machine, whereby the grinding machine is rotated by the movement of the motor by providing a pulley between the bearing and the motor disposed to be at the vertical bars.

In addition, the surface of the rotating grinding machine can be abutted against the side ridge portion and the side face of the concrete block by lowering the grinding machine originally positioned to be laterally and above the conveyer while rotating it by the rotating means.

It is preferable that the grinding machine comprises a cylindrical rotating shaft and a plurality of grinding fittings suspended from the surface of the rotating shaft. The grinding fittings have to be shaped so as to grind the ridge line portion and the side surface of the concrete block. For example, a needle-like bar may be welded so as to be upright from the surface of the rotating bar. Among other things, it is preferable that the grinding fittings be formed by chains. A tasteful ground surface can be obtained due to the irregular movement of the chains by grinding the concrete block with the tip portion of the chains utilizing the centrifugal force exerted on the chains. Further, the service life time of the grinding fittings can be lengthened by using the chains.

In a case where the ridge line portion of the concrete block is ground by the grinding machine, it is preferable that a means for pressing the upper surface other than the ridge line of the concrete block from above be provided. Any means may be adopted for the pressing means so long as it can press the concrete block so as to not displace the concrete block upon the grinding. For example, a cylinder may be disposed to be vertical with respect to the frame above the concrete block and a plate member whose area is smaller than the upper surface of the concrete block may be provided on the lower end of the cylinder, whereby the plane of the concrete block transported is pressed from above.

Next, the grinding operation of the ridge line portions and the side surface of the concrete block will be specifically described.

The grinding machine is rotationally supported at the lower ends of the two vertical bars facing each other along the direction in which the conveyor is advanced. Accordingly, it means that the grinding machine is located to be parallel to the direction in which the ridge line portions on the side surfaces of the concrete block transported extend.

In a case where the side ridge line portion and the side surface on the upper surface of the concrete block is ground, it is preferable that the grinding machine be rotated from above to below at the grinding position. Since the ground pieces of the concrete block can be blown away outside the conveyor by the fact that the grinding machine is rotated in such a direction, a continuous and stable grinding operation can be attained due to the fact that the ground pieces are not deposited on the conveyor.

In a case where the side ridge line portion on the bottom surface of the concrete block is ground, it is preferable that a means for switching the direction in which the grinding machine is rotated be provided for rotating the grinding machine from below to above at the grinding position. In a case where the side ridge line portion on the bottom surface is ground, a natural ground surface can be obtained by abutting the grinding fittings against it from below.

In this connection, two grinding machines disposed to be along the conveyor may be adopted in such a way that the side ridge line portion on the bottom surface of the one concrete block disposed to be upstream can be ground by the one grinding machine disposed to be upstream, while the side ridge portion on the upper surface of the other concrete block can be ground by the other grinding machine disposed to be downstream.

Off course, the side ridge line portion on the upper surface of the one concrete block disposed to be upstream can be ground by the one grinding machine disposed to be upstream, while the side ridge portion on the bottom surface of the other concrete block disposed to be downstream can be ground by the other grinding machine disposed to be downstream.

Since two concrete blocks can be ground simultaneously by such a structure, the grinding efficiency can be improved.

In such a case, it is preferable that a means for pressing from above the upper surfaces, other than the ridge lines, of the one concrete block remained stationary and disposed to be upstream and of the other concrete block remained stationary and disposed to be downstream be provided and that said pressing means include an elongated portion which can press the plane surfaces of both concrete blocks simultaneously, since the pressing means can be controlled by only one single cylinder.

In addition, two grinding machines, one of which is disposed to be on one side of the conveyor, while the other of which is disposed to be the other side thereof, may be adopted, whereby the right ridge line portion of the concrete block can be ground by the one grinding machine, while the left ridge line portion of the concrete block can be ground by the other grinding machine. Since right and left side surfaces of the concrete block can be ground simultaneously, the grinding efficiency can be improved.

Still further, a space for replacing the grinding machines at the side of the position where the concrete block on the conveyor is ground and a means for moving the cylinder which lowers and raises the grinding machine in the direction perpendicular to the direction in which the conveyor is advanced may be provided in such a way that the grinding machine can be movable to said space by said moving means. The operation for replacing the grinding machine can be simplified by providing such a space.

The First Embodiment

The method of grinding the concrete block according to the present invention will be now described with reference to the drawings.

Figure 2:
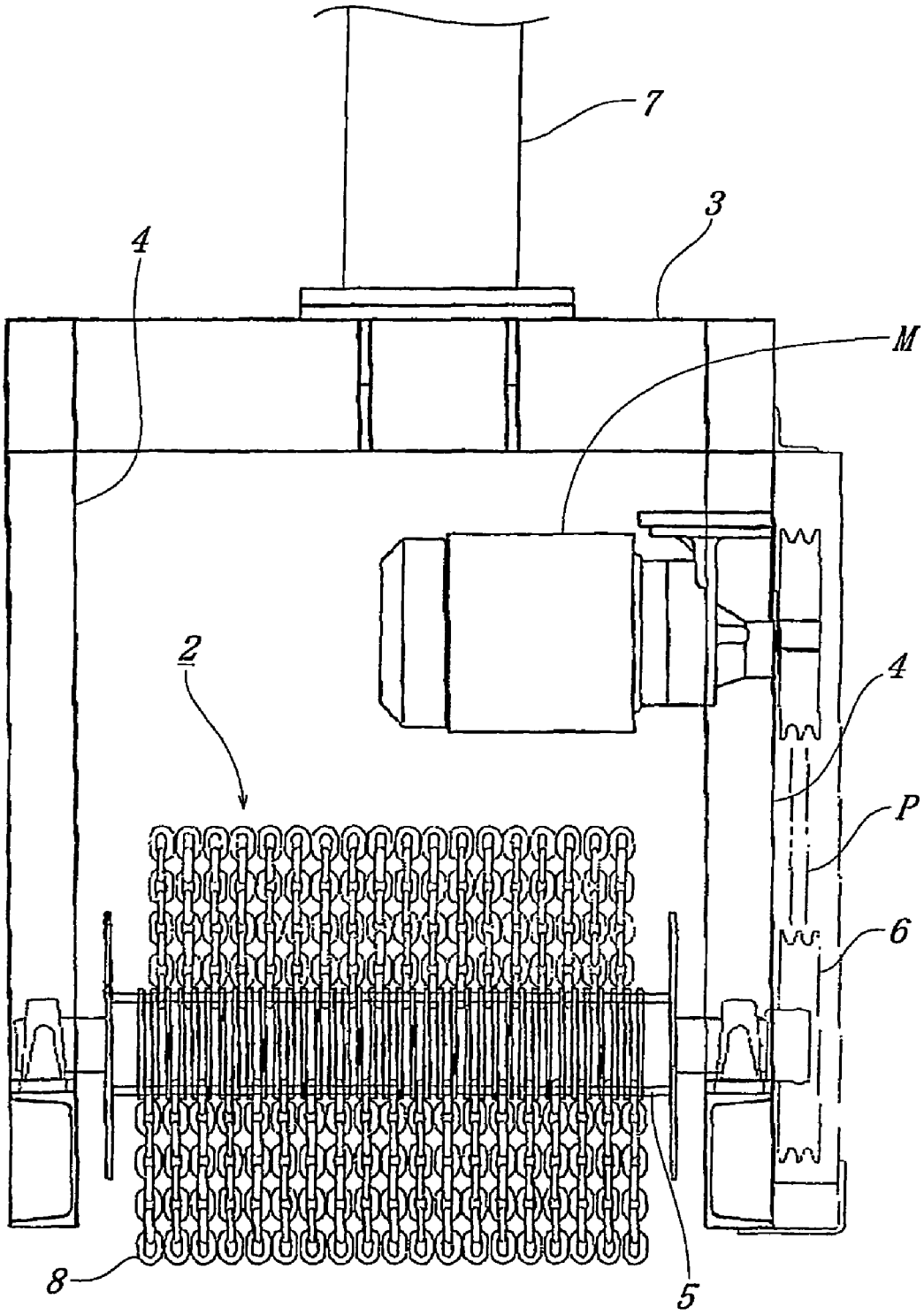
FIG. 2 is a side view showing a grinding apparatus of FIG. 1.

FIG. 1 shows the structure of the grinding apparatus 1 of the present invention seen along the direction in which the conveyor is advanced. FIG. 2 is a side view of FIG. 1.

As shown in FIG. 1, the concrete block 11 transported by the conveyor 10 is remained stationary at a position where it is to be ground by the grinding machine 2. At this stage, it is necessary for the side ridge line portion 13 on the bottom surface of the concrete block 10 to protrude from the conveyor 10.

The grinding machine 2 for grinding the ridge line of the concrete block is suspended from a frame 3 disposed to be above the conveyor 10. As shown in FIG. 2, the grinding machine 2 is rotationally supported at the lower ends of two vertical bars 4 which faces each other along the direction in which the conveyor is advanced. A cylinder 7 is provided at the center of the frame 3 so as to move the frame 3 upwardly and downwardly.

As shown in FIG. 1, the grinding machine 2 is rotationally supported at the lower ends of the vertical bars 4. The grinding machine 2 includes a cylindrical rotation shaft 5 and bearings are provided at both ends of the rotation shaft 5 to be supported by bearings 6 at the lower ends of the vertical bars 4.

A motor M is provided on the vertical bar, so that the grinding machine 2 can be rotated by the motor M through a pulley P provided between the motor M and the one end of the grinding machine 2.

As shown in FIG. 1, since the grinding machine 2 is located to be lateral with respect to the conveyor 10 and above the conveyor 10, the surface of the grinding machine 2 can be abutted against the side ridge line portion 14 and the side surface 15 of the concrete block 11 by rotating the grinding machine 2 by a rotating means, while at the same time lowering the grinding machine 2 by the cylinder 7.

The grinding machine 2 is formed by a cylindrical rotating bar 5 and chains 8 suspended from its surface. Six chains 8 are arranged in the circumferential direction with angularly spaced apart from each other by a constant distance. Further, as shown in FIG. 2, Eighteen sets of chains, each set consisting of six chains, are disposed in the longitudinal direction of the rotating bar 5 spaced apart from each other by a constant distance. Accordingly, the ridge line portion 14 on the upper surface of the concrete block 11 can be ground by the fact that the tip portions of the chains 8 abuts against the concrete block 11 due to the centrifugal force exerted on the rotating chains.

In addition, the side surface 15 of the concrete block 11 can be ground by lowering the grinding machine 2. Still further, the ridge line portion 13 on the bottom surface of the concrete block 11 can be ground by further lowering the grinding machine 2.

In a case where the side ridge line portion 14 and the side surface 15 on the upper surface of the concrete block is ground, it is preferable that the grinding machine 2 be rotated from above to below at a grinding position. This causes pieces of the ground concrete block 11 to be blown away outside the conveyor, so that ground pieces of the concrete block is prevented from depositing on the conveyor 10, whereby a stable continuous grinding operation can be attained.

While on the other hand, in a case where the side ridge line portion 13 on the bottom surface of the concrete block 11 is ground, it is preferable that the rotating direction of the grinding machine be switched by a means for switching the rotating direction of the grinding machine. In a case where the side ridge line 13 on the bottom surface is ground, a natural ground surface can be obtained by abutting the chains 8 of the grinding machine 2 from below.

The Second Embodiment

Figure 3:
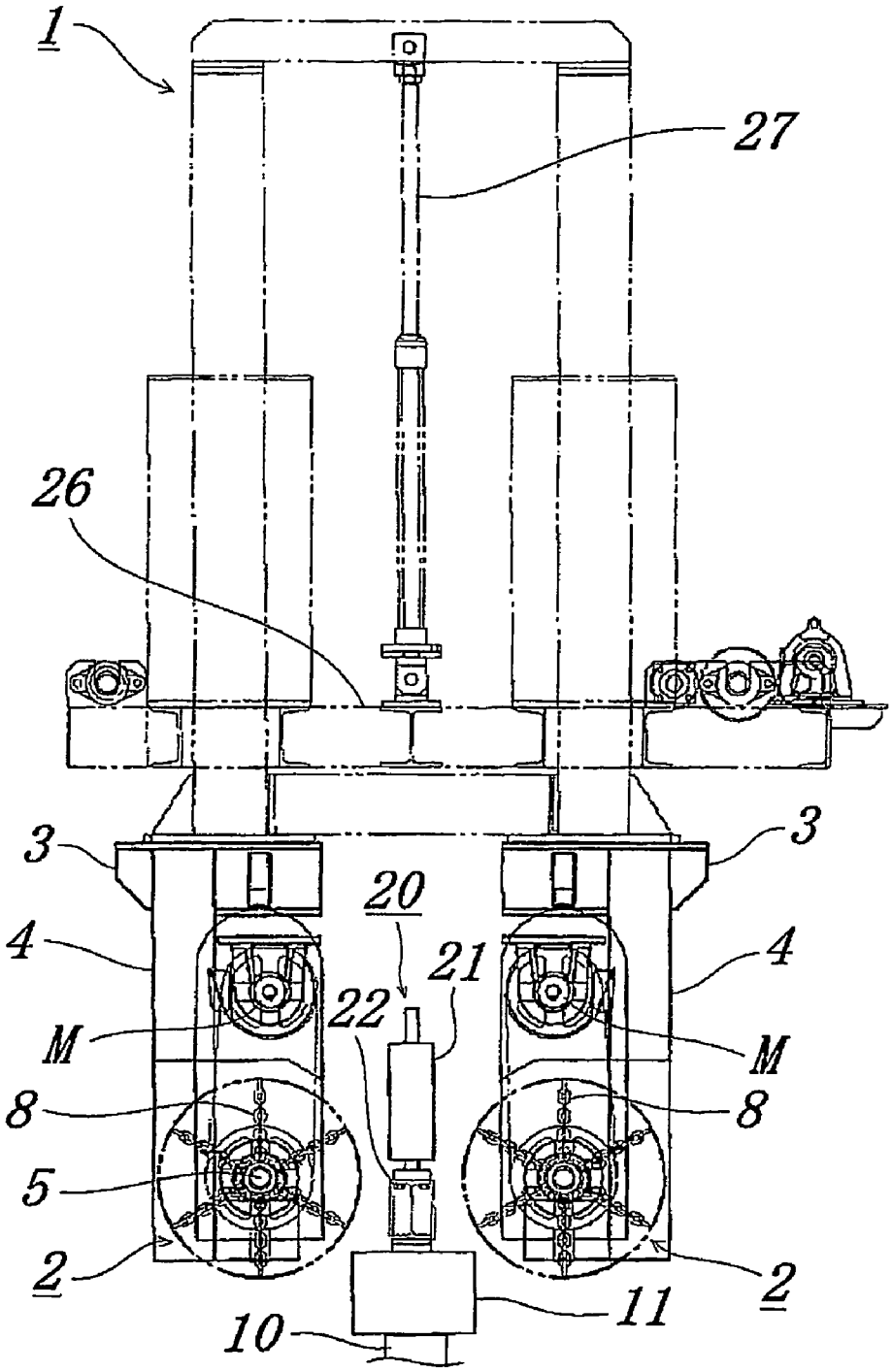
FIG. 3 is a view showing a second embodiment of a structure of a grinding apparatus of the present invention.

Another embodiment of the grinding apparatus 1 according to the present invention will be now described. In FIG. 3, a member including the same function as those in the first embodiment will be explained by using the same reference numbers.

In this embodiment, two grinding machines 2,2 are provided in such a way that the one is disposed to be on one side with respect to the conveyor, while the other is disposed to be on the other side. According to the two grinding machines 2,2, the ridge line portion and the side surface at the right side of the concrete block can be ground by the one grinding machine 2, while the ridge line portion and the side surface at the left side of the concrete block can be ground by the other grinding machine 2.

As shown in FIG. 3, the concrete block 11 transported by the conveyor 10 is remained stationary at the position where it is to be ground by the grinding machines 2,2. At this stage, it is necessary for the side ridge line portions on the bottom surface of the concrete block 11 to protrude from the conveyor 10.

In addition, the grinding machines 2,2 for grinding the ridge lines, etc. of the concrete block are suspended from frames 3,3 disposed to be above the conveyor 10. The grinding machines 2,2 are rotationally supported at the lower ends of two vertical bars 4,4 facing each other in the direction in which the conveyor is advanced. Another frame 26 is provided so as to bridge the frames 3,3 and a cylinder 27 is provided on its center and above the frame 26. The frames 3,3 are moved upwardly and downwardly by the cylinder 27.

As shown in FIG. 3, the grinding machines 2,2, are rotationally supported at the lower ends of the vertical bars 4,4. Each of the grinding machines 2,2 includes a cylindrical rotating bar 5 and bearings provided on both ends of the rotating bar are supported by bearing 6,6 at the lower ends of the vertical bars 4,4.

Motors M, M are provided on the vertical bars 4,4, so that the grinding machines 2,2, are rotated by the motors M, M through pulleys provided between the motors and the ends of the grinding machines.

As shown in FIG. 3, since the grinding machines 2,2, are situated to be lateral to and above the conveyor 10, the surfaces of the rotating grinding machines 2,2 can be simultaneously abutted against the side ridge line portions and the side surfaces of both sides of the concrete blocks by rotating the grinding machines 2,2 by a rotating means, while at the same time lowering the grinding machines by the cylinder 27.

The grinding machines 2,2, includes the cylindrical rotating bars 5,5 and chains 8,8 suspended from their surfaces. The tip portions of the chains 8,8 are abutted against the concrete block 11 due to the centrifugal force exerted on the rotating grinding machines 2,2 so that both ridge line portions on the upper surface of the concrete block can be ground.

In addition, the side surface of the concrete block 11 can be ground by lowering the grinding machines 2,2. Further, the two ridge line portions on the bottom surface of the concrete block 11 can be ground by further lowering the grinding machines 2,2.

In a case where the side ridge line portion and the side surface on the upper surface of the concrete block 11 is to be ground, it is preferable that the grinding machines 2,2 be rotated from above to below at the grinding position. This causes the pieces of the ground concrete block 11 to be blown away outside the conveyor, so that the ground pieces of the concrete block are prevented from depositing on the conveyor 10, whereby a stable continuous grinding operation can be attained.

While on the other hand, in a case where the side ridge line portion on the bottom surface of the concrete block 11 is ground, it is preferable that the rotating direction of the grinding machine be switched by a means for switching the rotating direction of the grinding machine. In a case where the side ridge line 13 on the bottom surface is ground, a natural ground surface can be obtained by abutting the chains 8 of the grinding machines 2,2 from below.

The Third Embodiment

Next, a still further embodiment of the apparatus 41 for grinding concrete blocks will now be described with reference to FIG. 4.

In this embodiment, two grinding machines 42,52 are provided along the conveyor 50, whereby the side ridge line portion on the bottom surface of the concrete block 51, which is stationary and disposed upstream, can be ground by the grinding machine 42 disposed upstream, while the side ridge line portion of on the upper surface of the concrete block, which is stationary and disposed downstream, can be ground by the grinding machine 42 disposed downstream.

Figure 4:
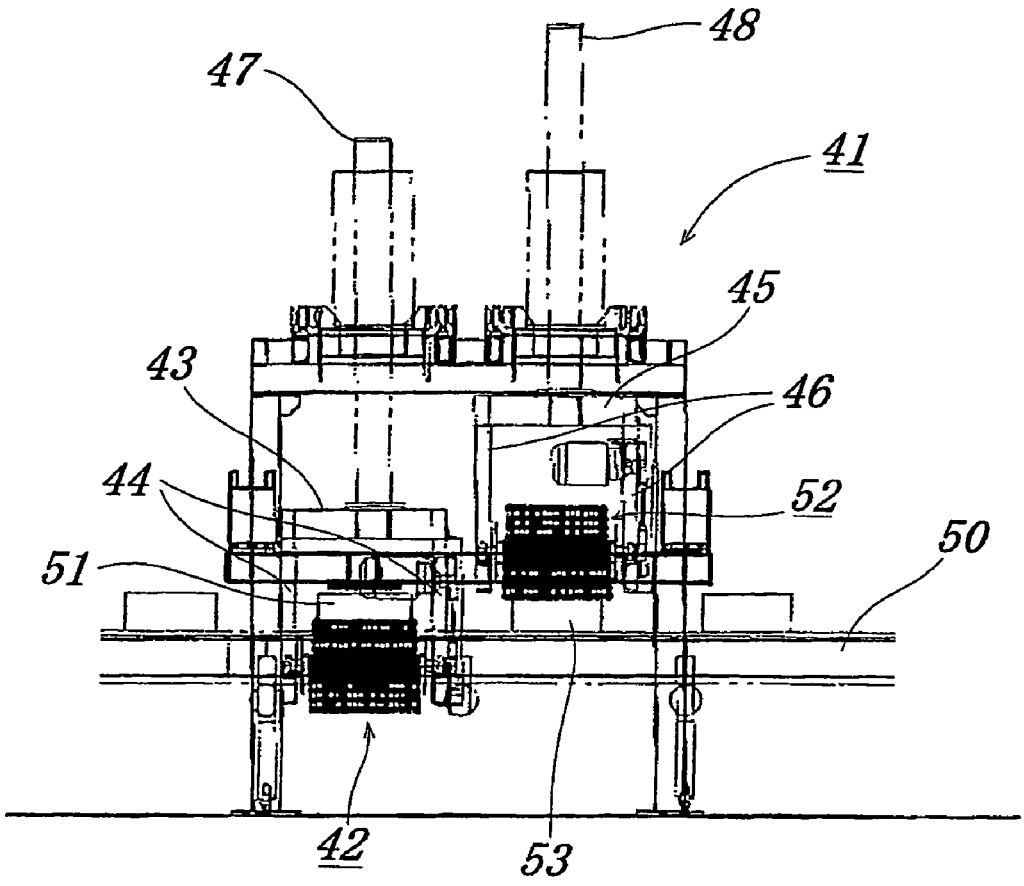
FIG. 4 is a view showing a third embodiment of a structure of a grinding apparatus of the present invention.

As shown in FIG. 4, the concrete block 51 transported by the conveyor 50 is held stationary at the position where it is ground by the upstream grinding machine 42.

The grinding machine 42 for grinding the ridge lines, etc. of the concrete block 51 is suspended from a frame 43 disposed above the conveyor 50. The grinding machine 42 is rotationally supported at the lower ends of the two vertical bars 44,44 facing each other in the direction in which the conveyor is advanced. Further, a cylinder 47 is provided at the center of the frame 43 and thereabove so that the frame 43 can be moved upwardly and downwardly. On the other hand, the concrete block 53 is held stationary at the position where it is ground by the downstream grinding machine 52.

In addition, the grinding machine 52 for grinding the ridge line portion, etc. of the concrete block 53 is suspended from a frame 45 disposed to be above the conveyor 50. The grinding machine 52 is rotationally supported at the lower ends of the two vertical bars 46,46 facing each other in the direction in which the conveyor is advanced. Further, a cylinder 48 is provided at the center of the frame 45 and thereabove so that the frame 45 can be moved downwardly and upwardly.

The side ridge line portions of the concrete block can be ground simultaneously by the grinding machines 42,52 including the above-described structure, so that the efficiency for grinding the concrete block can be increased.

The Fourth Embodiment

Next, a still further embodiment of the apparatus 60 for grinding concrete blocks will now be described with reference to FIG. 5.

In the grinding apparatus 60 for the concrete block of this embodiment, a space S for replacing the grinding machines 62,62 is provided at the side of the position where the concrete block is ground on the conveyor 70 and a means for moving a cylinder 72, which upwardly and downwardly moves the grinding machines 62,62, in the direction perpendicular to the direction in which the conveyor 70 is advanced (see an arrow in FIG. 5) are provided. The grinding machine 62 may be moved to the space S by said moving means.

The provision of such a space S causes the replacing operation of the failed grinding machine 62 with the new one to be simplified.

Two grinding machines 62,62 of this embodiment are provided in such a way that one of them is disposed to be on one side of the conveyor and the other is disposed to be on the other side thereof. According to the two grinding machines, the ridge line portion and the side surface at the right side of the concrete block 71 can be ground by the one grinding machine 62, while the ridge line portion and the side surface at the left side of the concrete block 71 can be ground by the other grinding machine 62.

Figure 5:
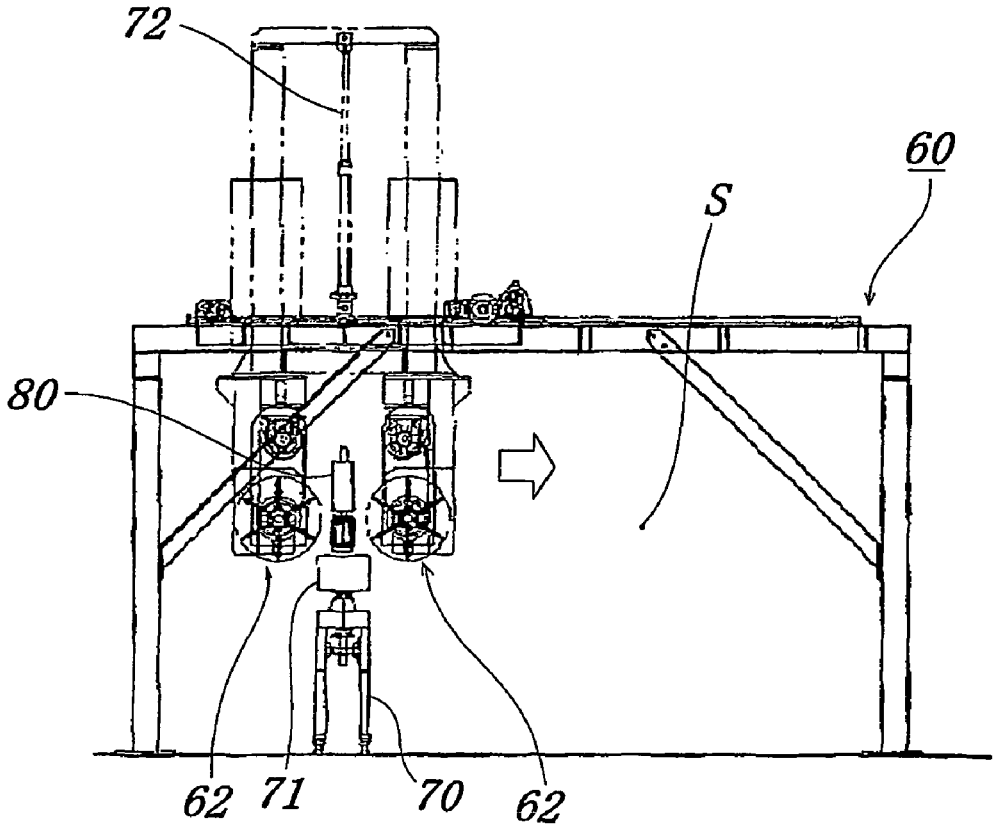
FIG. 5 is a view showing a fourth embodiment of a structure of a grinding apparatus of the present invention.

As shown in FIG. 5, the concrete block 71 transported by the conveyor 70 is held stationary at the position where it is ground by the grinding machines 62, 62. At this stage, it is necessary for the side ridge line on the bottom surface of the concrete block 71 to protrude from the conveyor 70.

Further, the ridge line portion and the side surface of the concrete block 71 can be ground by lowering the grinding machines 62,62. Still further, the ridge line portions on both sides of the bottom surface of the concrete block 71 can be ground by further lowering the grinding machines 62,62.

In a case where the side ridge line portions and the side surface on the upper surface of the concrete block 71 is to be ground, it is preferable that the grinding machines be rotated from above to below at the grinding position. This causes the pieces of the ground concrete block 11 to be blown away outside the conveyor, so that ground pieces of the concrete block is prevented from depositing on the conveyor 10, whereby a stable continuous grinding operation can be attained.

What is claimed is:

1. An apparatus for grinding concrete blocks comprising:

a conveyor which transports the concrete blocks to a position where they are ground;

a frame disposed above the conveyor;

a grinding machine suspended from the frame and rotationally supported at lower ends of two vertical bars suspended from said frame and facing each other in the direction in which the conveyor is advanced;

a rotating shaft of said grinding machine which is rotationally supported by said two vertical bars;

means for rotating said rotating shaft; and means for switching the direction in which the grinding machine is rotated, wherein when a side ridge portion on an upper surface of the concrete block is ground, the grinding machine is rotated from above to below at a grinding position, while when a side ridge portion on a bottom surface of the concrete block is ground, the grinding machine is rotated from below to above at the grinding position, ridge line portions and/or side surfaces of the concrete blocks on the upper and the bottom surfaces of the concrete block can be ground by positioning the side ridge line portions on a bottom surface of the concrete block so as to protrude from the conveyor and positioning the axis of the rotating shaft to be lateral to and above the conveyor and then lowering the grinding machine so as to abut its surface against the ridge line portions and/or side surfaces.

2. The apparatus for grinding concrete blocks according to claim 1 further including means for pressing from above an upper surface of the concrete block held stationary other than the ridge lines thereof.

3. The apparatus for grinding concrete blocks according to claim 1, wherein said grinding machine comprises the rotating shaft and a plurality of grinding fittings suspended from a surface of the rotating shaft and the grinding fittings are formed by chains.

4. An apparatus for grinding a surface of a concrete block comprising:

a grinding machine comprising a rotating shaft which is vertically and horizontally movable, a plurality of chains angularly spaced apart from each other in a circumferential direction and arranged to be closely adjacent to each other in the longitudinal direction, one end of each of which is fixed to a peripheral surface of said rotation shaft;

means for rotating said rotation shaft; and means for switching the direction in which the grinding machine is rotated, wherein when a side ridge portion on an upper surface of the concrete block is ground, the grinding machine is rotated from above to below at a grinding position, while when a side ridge portion on a bottom surface of the concrete block is ground, the grinding machine is rotated from below to above at the grinding position, wherein a surface of a concrete block is ground by abutting an outer circle of a rotation trace formed by the other ends of said rotating chains against the side surface of the concrete block, while at the same time said rotating shaft is vertically moved.

* * * * *